US005114014A

United States Patent [19]

Ascalon et al.

[11] Patent Number: 5,114,014

[45] Date of Patent: May 19, 1992

[54] TOKEN HOLDER

[76] Inventors: David Ascalon; Maurice Ascalon, both of 115 Atlantic Ave., Berlin, N.J. 08009

[21] Appl. No.: 656,747

[22] Filed: Feb. 19, 1991

[51] Int. Cl.[5] ..... A45C 1/00

[52] U.S. Cl. ..... 206/0.84; 206/445

[58] Field of Search ..... 206/0.8–0.84, 206/445; 150/150, 900

[56] References Cited

U.S. PATENT DOCUMENTS

| | | | |
|---|---|---|---|
| 364,468 | 6/1887 | Bierky | 206/0.84 |
| 663,016 | 12/1900 | Eiseman | 206/0.81 X |
| 1,509,861 | 9/1924 | Coleman | 206/0.81 |
| 1,863,150 | 6/1932 | Allen | 206/0.81 X |
| 2,119,773 | 6/1938 | Buckner | 150/150 X |
| 2,185,359 | 1/1940 | Swanson | 206/0.81 |
| 2,388,221 | 10/1945 | Smith | 206/0.8 |
| 2,408,751 | 10/1946 | Breiter et al. | 206/0.8 |
| 2,547,512 | 4/1951 | Whitcomb | 206/0.83 |
| 2,561,687 | 7/1951 | Craig et al. | 206/0.81 |
| 2,569,629 | 10/1951 | Everitt | 206/0.81 |
| 2,642,985 | 6/1953 | Whitcomb | 206/0.83 |
| 2,690,200 | 9/1954 | Page | 206/0.84 |

FOREIGN PATENT DOCUMENTS 2519924 11/1976 Fed. Rep. of Germany ..... 206/0.8

*Primary Examiner*—Bryon P. Gehman

*Attorney, Agent, or Firm*—Norman E. Lehrer; Franklyn Schoenberg

[57] ABSTRACT

A token or coin holder is provided having a substantially rigid body with spaced substantially parallel top and bottom walls and opposing side walls connecting said top and bottom walls and cooperating therewith to define a coin or token chamber having an open end to receive coins or tokens to be contained by the holder and to dispense the same, the top wall includes an aperture portion extending longitudinally therethrough through which tokens and coins carried thereby may be viewed and manipulated, the holder having an inclined ramp disposed in a closed end of the token chamber associated in cooperative relationship with an undulated surface extending along an inner face of the bottom wall and a sawtooth configured surface extending along an inner face of the top wall opposite the undulated inner face of the bottom wall which cooperatively operate to retain a plurality of tokens or coins aligned in a longitudinal array within the token chamber with successive tokens in the array being disposed in a partial overlapping relationship.

5 Claims, 2 Drawing Sheets

TOKEN HOLDER

FIELD OF THE INVENTION

The present invention relates to coin holders and, more particularly, to a simple device for holding a plurality of coins or tokens of a particular denomination or size which may be quickly received and individually dispensed thereby and will retain such coins or tokens when completely or partially filled.

BACKGROUND OF THE INVENTION

A variety of holders and receptacles have been disclosed and used in the past for holding, carrying and dispensing coins and tokens. These include devices which are used only as token or coin holders such as disclosed, for example, in U.S. Pat. Nos. 682,852, 1,378,277, 2,117,516 and 2,227,191; devices used to hold a combination of items such as coins or tokens together with car keys and the like as disclosed, for example, in U.S. Pat. Nos. 2,569,629, 3,473,648 and 4,305,497; and coin or token holders used in association with pocketbooks, wallets and the like such as disclosed in U.S. Pat. Nos. 663,016, 1,863,150, and 2,013,485.

The use of tokens for transit fares, highways tolls and the like is widespread. These tokens, by virtue of their similarity in size and form to coins issued as legal money, may be mistaken therefor at times even though their value and suitability for use may be different. It would be very desirable to have a holder in which a quantity of such tokens may be carried in a purse or pocket identifiably separate from coins and other items without adding objectionable bulk thereto and which would make them ready and available for use when needed. Such holders from which the tokens are conveniently dispensed one at a time without undue manipulation or accidental displacement of others in the holder, or which may also be used to carry a quantity of coins of various denominations in a convenient way would be particularly desirable.

The devices heretofore used as coin and token holders have not been entirely satisfactory being that they generally serve to hold the tokens aligned in an end-to-end array, thus limiting the number that may be available and necessitating frequent refilling to provide a sufficient number to be used over even short periods of time (transit fares or highway tolls for several trips), and many require special effort and manipulation to dispense the coins or tokens when needed, employ special structural configurations to avoid inadvertent displacement of coins or tokens from the holder which are not full and the like.

SUMMARY OF THE INVENTION

It is accordingly an object of the present invention to provide a simple device for receiving and dependably holding coins and tokens which will enable the ready dispensing of such articles from the holder when needed without undue manipulation by the user and will prevent accidental displacement from the holder when full or partially empty while being carried or used, the device being fabricated so as not to add substantially to the bulk thereof when carried in a purse or pocket.

It is another object of the present invention to provide a simple device which can be economically fabricated for carrying a plurality of tokens and coins from which such articles can be conveniently dispensed, preferably one at a time, without accidental displacement of items remaining in the holder.

It is a further object of the present invention to provide a simple device which can be readily and economically fabricated as a unitary structure and is capable of readily receiving and carrying an adequate supply of fare tokens and the like for use over an extended period from which the tokens and the like can be readily dispensed by the user without accidental displacement of the tokens from the holder, the device being suitable for use by a transportation company or the like to sell a predetermined quantity of the tokens.

It is a still further object of the invention to provide a simple, economical holder for tokens and coins wherein the number of articles within the holder may be readily counted and the tokens or coins within the holder may be only moved toward their point of egress and readily dispensed therefrom one at a time without undue manipulation by the user.

In accordance with the present invention there is provided a token holder which readily receives, dependably holds and easily releases coins or tokens comprising a substantially rigid body having spaced apart substantially parallel top and bottom walls and side walls connecting said top and bottom walls and cooperating therewith to define a coin or token chamber having an open end to receive coins or tokens to be contained by the holder and to dispense the same. The top wall has an aperture portion extending longitudinally therethrough through which tokens and coins carried thereby may be viewed and manipulated. The holder also has token retaining means within the token chamber adapted for dependably retaining a plurality of tokens or coins aligned in a longitudinal array within the token chamber with successive tokens in said array being disposed in a partial overlapping relationship.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one embodiment which is presently preferred; it being understood that the invention is not intended to be limited to the precise arrangements and instrumentalities shown.

DESCRIPTION OF THE PREFERRED EMBODIMENT

Figure 1:
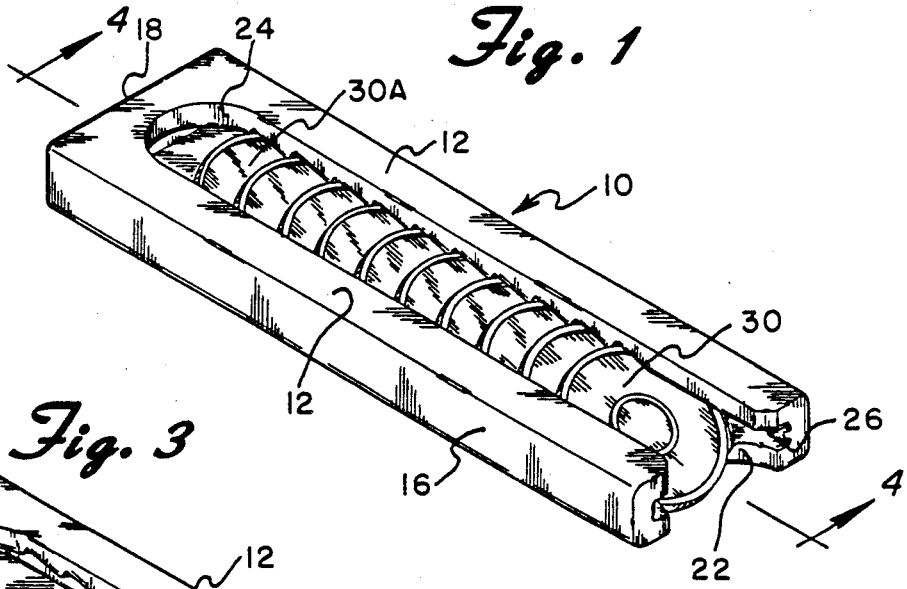
FIG. 1 is a top view in perspective of a token holder in accordance with the invention with a plurality of tokens carried thereby.

Referring now to the drawings, where like reference numerals identify like parts, there is shown in FIGS. 1 to 6, by way of illustration, but not of limitation, a token holder in accordance with the invention shown generally as 10. Token holder 10 includes spaced top 12 and bottom 14 walls with spaced side walls 16 and an end wall 18 integral with and connecting the top 12 and bottom 14 walls and cooperating therewith to define a token retaining chamber 20. One end 22 of the holder 10 is open to receive tokens to be retained therein and through which the tokens can be dispensed. An arcuate concave cut-out 21 is formed at the terminal edge of the bottom wall 14 to assist in inserting and removing tokens from the holder through the open end 22 thereof and opposing small protrusions 26 which project from the opposing inner faces of the side walls 16 adjacent the terminal edges thereof are provided to assist in the retention of tokens within the token chamber 20.

A central aperture 24 is formed in the top wall 12 extending longitudinally almost the length thereof to the open end 22 of the holder through which tokens carried within the holder may be viewed and manipulated. The holder 10 may be fabricated of any suitable strong, substantially rigid plastic material by conventional molding techniques whereby the holder may be integrally formed or the parts thereof may be fabricated separately from suitable rigid materials including plastics, metal and the like and then assembled by conventional means.

The inner faces of the top and bottom walls 12, 14, side walls 16 and end wall 18 defining the token retaining chamber 20 are uniquely constructed and configured to be suitable for dependably retaining a plurality of tokens or coins 30 therein as well as being adapted for readily receiving and dispensing tokens or coins. A plurality of tokens or coins are retained within the chamber in an aligned longitudinal array with each successive token in the array partially overlapping the top surface of a token immediately preceding it in the array and with the top front edge and opposite bottom rear edge of each token being in simple manipulative coupling with respective engaging points formed in the opposing inner faces of the top and bottom walls 12 and 14 defining the token chamber 20.

For these purposes, a pair of spaced inclined guide rails or ramps 15 are disposed on and project inwardly from the inner face of the bottom wall 14 and extend forwardly contiguous with the opposite side walls 16 from the closed end wall 18 for a portion of the length of the holder, the guide rails or ramps 15 being inclined upwardly from the bottom wall 14 in the direction of the end wall 18. The bottom wall 14 is formed with an undulated inner face 13 extending forwardly from the guide rails 15 to the open end 20 of the holder 10, the undulated configuration of the inner face 13 being shaped to provide a plurality of arcuate convex restraining ridges therein of a diameter substantially similar to that of tokens to be retained thereby.

The opposing inner face of the top wall 12 is provided with a plurality of successive support ridges in a generally sawtooth-configuration 11 which extend substantially the length of said holder with the first of said support ridges adjacent the end wall 18 being disposed in general alignment with the upwardly inclined slope of guide rails 15 to provide for the receiving and engagement of a portion of the top front edge of a token supported on the guide rails 15. The support ridges 11 in the inner face may be formed in an arcuate concave configuration of a diameter substantially the same as the diameter of tokens to be retained therein or may be formed transverse to the longitudinal axis of the holder 10.

As indicated, small protrusions 26 are also provided which project inwardly from the opposing inner faces of sidewalls 16 at the terminal edges thereof. Such protrusions provide further assistance in retention of tokens within the token chamber 20, particularly in the event of inadvertent displacement of a token from the retaining couple during carrying or use of the holder.

Figure 3:
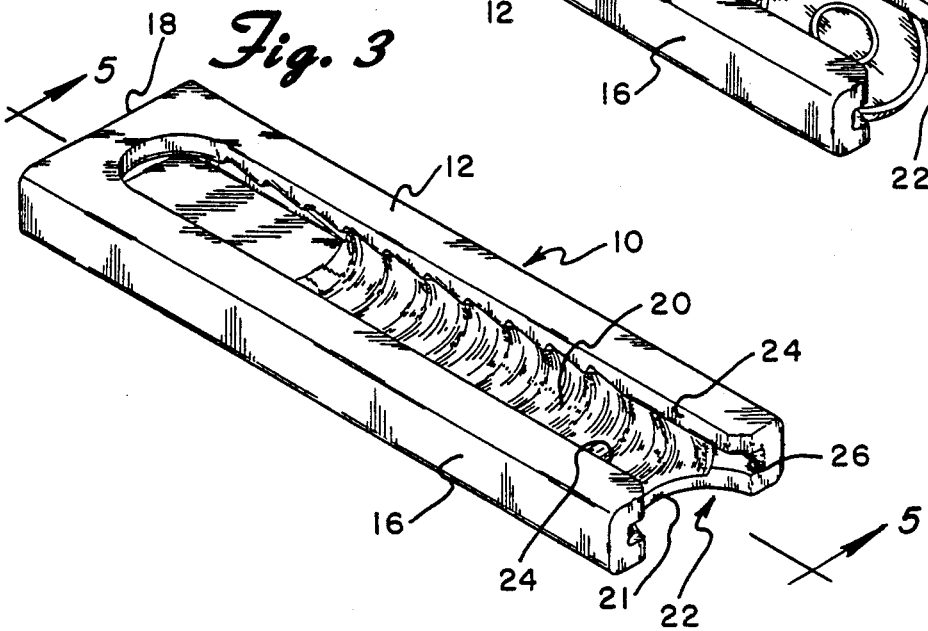
FIG. 3 is a bottom view in perspective of the token holder shown in FIG. 1.
Figure 2:
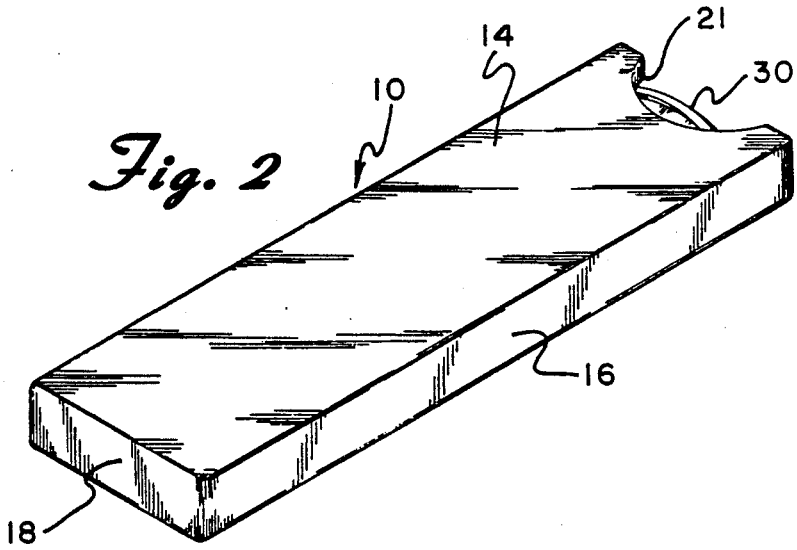
FIG. 2 is a top view in perspective of the token holder shown in FIG. 1 from which the tokens have all been dispensed.
Figure 4:
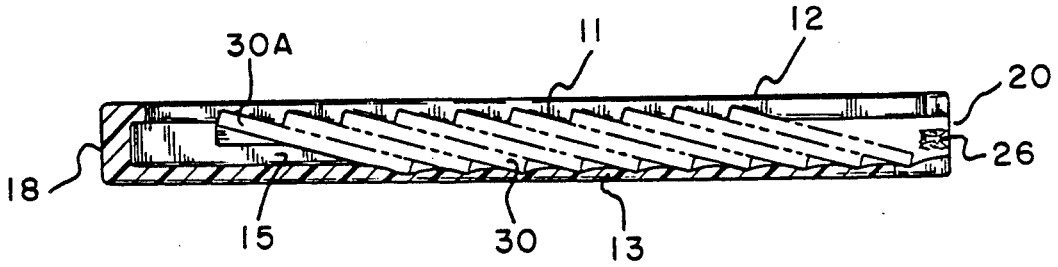
FIG. 4 is a sectional view taken along line 4—4 of FIG. 1.
Figure 5:
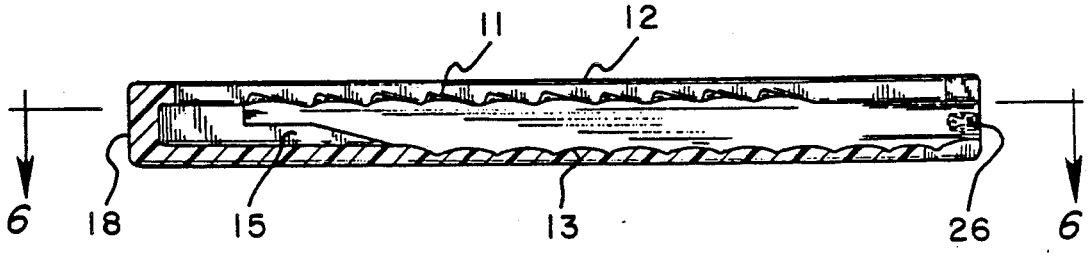
FIG. 5 is a sectional view taken along line 5—5 of FIG. 2.
Figure 6:
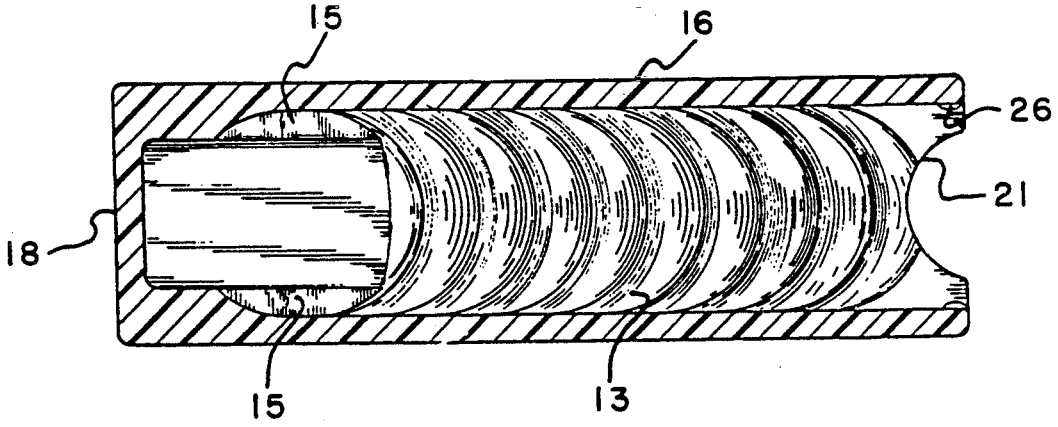
FIG. 6 is a sectional view taken along line 6—6 of FIG. 5.

In FIGS. 1, 3 and 4, the token holder 10 of the invention is shown as retaining 10 tokens 30 of essentially the same size arranged in an aligned partially overlapping array within the token retaining chamber 20, the array of tokens being readily viewed through the aperture 24 in the top wall 12 of the holder 10. The array of tokens 30 is positively and effectively retained within the chamber 20 by virtue of the first token 30A being supported upon the spaced guide rails 15 in the closed end of the chamber with portions of the opposing top and bottom edges of token 30A being coupled between a respective support ridge 11 formed in the inner face of the top wall 12 and a restraining ridge 13 formed in the undulated inner face of the bottom wall 14. Successive tokens 30 are similarly effectively retained in a partially overlapping array by virtue of the couple formed between the opposing edges of the tokens in engagement with respective support and restraining ridges 11, 13 in the opposing inner faces of the top and bottom walls 12, 14. In the case where one or more of the token 30 have been dispensed from within the holder 10, the remaining tokens in the array will nevertheless be effectively and positively retained within the holder 10.

Filling the holder 10 with tokens is readily accomplished by inserting a token through the open end of the holder 10 and then advancing it by finger pressure through aperture 24 until the token bears on the guide rails 15 and a portion of the front edge is received and engaged by a support ridge 11 along the inner face of the top wall 12. The restraining couple for the token can then be completed by finger pressure seating the bottom edge of the token in the respective restraining ridge 13 in the inner face of the bottom wall 14. This procedure would be continued until all the tokens were properly retained within the chamber 20 of holder 10. The holder 10 of the invention may be used for sale of a predetermined quantity of tokens by a transit company or the like, the size of token holder being dependent on the size and desired quantity of tokens or coins to be carried thereby.

Removal of the tokens is readily accomplished by finger pressure through the aperture 24 being applied to the top edge of the last token in the array in an amount sufficient to dislodge the bottom edge of the token from the restraining ridge 13 in the inner face of the bottom wall 14 and then sliding the token out endwise through the open end 20 of the holder 10. In this way, the tokens may be dispensed one at a time as needed without displacement of other tokens in the array.

From the foregoing it should be readily apparent to those skilled in the art that the token holder 10 of the present invention having a retaining chamber in which a plurality of tokens or coins can be dependably carried without inadvertent displacement of the tokens or coins, and from which the tokens or coins can readily dispensed one at a time provides a device which has a multitude of uses for carrying and dispensing tokens and coins of various sizes, denominations and quantities by simply changing the size of the holder.

Having thus described the invention in relation to the drawings hereof, it will be clear that modifications could be made in the preferred embodiment without departing from the spirit of the invention. Accordingly, it is not intended that the words used to describe the invention be limiting thereof nor should the drawings be considered so. It is intended that the invention be limited only by the scope of the appended claims.

What is claimed is:

1. A token holder which readily receives, dependably holds and easily releases coins or tokens comprising: a substantially rigid body having spaced substantially parallel top and bottom walls and opposing side walls connecting said top and bottom walls and cooperating therewith to define a coin or token chamber having an open end to receive coins or tokens to be contained by the holder and to dispense the same, said top wall having an aperture portion extending longitudinally therethrough through which tokens and coins carried thereby may be viewed and manipulated; said holder having token retaining means within said token chamber adapted for dependably retaining a plurality of tokens or coins aligned in a longitudinal array within said token chamber with successive tokens in said array being disposed in a partial overlapping relationship, said retaining means comprising an inclined ramp means disposed in a closed end of the token chamber associated in cooperative relationship with an undulated surface extending along an inner face of the bottom wall and a sawtooth-configured surface extending along an inner face of the top wall opposite the undulated inner face of the bottom wall.

2. The token holder as claimed in claim 1, wherein said sawtooth-configured surface includes a plurality of retaining ridges with at least a first of said ridges being in alignment with said inclined ramp means for receiving and retaining a portion of an edge of a token bearing on said ramp means.

3. The token holder as claimed in claim 1, wherein said side walls include a protrusion projecting inwardly from opposing inner surfaces thereof adjacent terminal edges of the side walls defining the open end of said token chamber.

4. The token holder as claimed in claim 1, wherein said walls of said holder are integrally formed.

5. The token holder as claimed in claim 1, wherein said holder is fabricated from a substantially rigid plastic material.

* * * * *